US007797776B2

(12) United States Patent
Joy

(10) Patent No.: US 7,797,776 B2
(45) Date of Patent: Sep. 21, 2010

(54) FLUIDIZED SUPPORT BED

(75) Inventor: James Joy, Houston, TX (US)

(73) Assignee: Aurora Manufacturing LLC, Mount Vernon, OH (US)

( * ) Notice: Subject to any disclaimer, the term of this patent is extended or adjusted under 35 U.S.C. 154(b) by 329 days.

(21) Appl. No.: 11/977,464

(22) Filed: Oct. 25, 2007

(65) Prior Publication Data

US 2008/0127422 A1 Jun. 5, 2008

Related U.S. Application Data

(60) Provisional application No. 60/854,139, filed on Oct. 25, 2006.

(51) Int. Cl.
*A61G 7/057* (2006.01)

(52) U.S. Cl. ..... 5/689; 5/702; 5/911

(58) Field of Classification Search ..... 5/689, 5/655.4, 654, 644, 702, 911, 939
See application file for complete search history.

(56) References Cited

U.S. PATENT DOCUMENTS 4,425,676 A * 1/1984 Crane ..... 5/689
4,483,029 A * 11/1984 Paul ..... 5/689
4,599,755 A * 7/1986 Tominaga ..... 5/689
4,637,083 A * 1/1987 Goodwin ..... 5/689
4,794,659 A * 1/1989 Kurita et al. ..... 5/689
4,835,802 A * 6/1989 Purcey et al. ..... 5/689
4,914,760 A * 4/1990 Hargest et al. ..... 5/689
4,942,635 A * 7/1990 Hargest et al. ..... 5/689
4,967,431 A * 11/1990 Hargest et al. ..... 5/689
5,008,965 A * 4/1991 Vrzalik ..... 5/689
5,029,352 A * 7/1991 Hargest et al. ..... 5/689
5,036,559 A * 8/1991 Hargest ..... 5/689
6,073,289 A * 6/2000 Bolden et al. ..... 5/689
6,430,765 B1 * 8/2002 Ozarowski et al. ..... 5/689
6,624,419 B2 * 9/2003 Ozarowski et al. ..... 250/341.1
2002/0157187 A1 * 10/2002 Ozarowski et al. ..... 5/689
2008/0127422 A1 * 6/2008 Joy ..... 5/689
2010/0088825 A1 * 4/2010 Howell et al. ..... 5/689

* cited by examiner

*Primary Examiner*—Robert G Santos
(74) *Attorney, Agent, or Firm*—James A. Hudak

(57) ABSTRACT

A fluidized bed for supporting a patient has a fluid-impervious peripheral wall, a fluid-porous membrane top covering and a fluid-porous floor defining a unit volume in which a quantity of glass bead support media is confined. Several diffusers supply air through the floor to fluidize the support media and support a body on the bed top covering. Each diffuser is a laminate having a porous membrane top and a porous membrane bottom spaced by a fluid-impervious boundary wall and a plurality of fluid-impervious interior walls that create discrete cells. Each cell contains a quantity of glass bead cell media. A pair of blowers supplies pressure air through one-way valves to the cells in the diffusers and through the cells up into the unit interior volume to fluidize the support media. Unequal distribution of support media causes a localized drop in air flow beneath an area of low media density and a consequent air pressure increase in the cells below an area of high media density, increasing air pressure in the support media above, which causes the support media to self-level to equalize pressure throughout the unit volume.

12 Claims, 14 Drawing Sheets

FLUIDIZED SUPPORT BED

RELATED APPLICATIONS

This application is a regular Utility filing of, and claims priority of, U.S. Provisional Patent Application Ser. No. 60/854,139, filed Oct. 25, 2006.

BACKGROUND OF THE INVENTION

1. Technical Field

This invention relates generally to fluidized support beds, and more particularly, to an air support bed that utilizes fluidized pellets in a mattress to support a body on the bed.

2. Background Art

Beds that utilize a confined quantity of a medium of fluidized pellets in the form or silica beads, or media, to support ulcerated or burned bodies of hospital bed-ridden patients are well known in the art. Basically a mattress in the form of a generally rectangular bag has fluid impervious walls and bottom and a fine mesh or membrane support surface on which the patient lies. The bag is filled with a plurality of pellets or beads that are suspended by air pressure in the bag, which is usually supplied by a blower through a port in the bag bottom. Examples of this are shown in U.S. Pat. No. 3,428,973—Hargest et al. One problem with such a fluidized bed is that the weight distribution of the patient creates an unequal fluid flow and, hence, pressure distribution across the entire bed. The position of the patient's body on the mattress varies the supporting pressure throughout the mattress, which causes unequal support of various portions of the patient's anatomy.

One method of equalizing pressure across the support surface is to make the pore size of the membrane exceedingly small, to more nearly equalize the flow rate by using a much higher pressure throughout the mattress. This results in the need to utilize a powerful blower which increases the cost. Other attempts to equalize the pressure distribution across the entire bed are disclosed in U.S. Pat. No. 4,637,083—Goodwin, U.S. Pat. No. 4,425,676—Crane, and U.S. Pat. No. 4,599,785—Tominaga, which all attempt to compartmentalize the mattress and isolate each compartment. This isolation attempts to equalize the pressure for all compartments and equally support all body portions with equal pressure. None of the structures in these patents truly creates an equal pressure distribution across the mattress and resultant equal support for all portions of the patient's body. A comprehensive summarization of the prior art patents which address the problems involved in providing a hospital patient support bed can be found in Published U.S. Application US 2005/0060809, published Mar. 24, 2005, section entitled "DESCRIPTION OF PRIOR ART" which is incorporated herein by reference. All presently known designs fail to provide equal support for all portions of a body that is placed on the mattress, regardless of the orientation and location of the body on the mattress.

It would be desirable to provide a fluidized bed that provides equal support for all portions of a body that is placed on the mattress, regardless of the orientation and location of the body on the mattress.

SUMMARY OF THE INVENTION

Thus it is one object of this invention to provide a fluidized bed that provides equal support for all portions of a body that is placed on the bed, regardless of the orientation and location of the body.

In a typical hospital fluidized bed, it is common to utilize air as the supporting fluid and use spherical glass beads of a diameter in the range of 50-150 microns as the fluidized media. The media need not all have a uniform size. The air flow through the media causes it to fluidize and distribute along the bottom of the top membrane, which must have a pore size smaller than the smallest glass bead. This distribution is not equal, for media thickness is not regulated to be uniform across the membrane bottom. Since flow volume is of necessity limited, the location where the media is thickest, the air flow will be less, a situation that is not self-correcting, but, rather, is self-aggravating.

As a result, the unequal weight distribution in the body of a patient supported on a conventional fluidized bed causes the media to compress under the large area of the patient's back. Because airflow over the entire membrane area is not regulated, airflow is much higher in other areas, which causes higher media density and less support under the patient's back. Theoretically, this problem of uneven media distribution, which causes uneven flow volume, can be overcome if each square inch, millimeter or infinitely small area has its own flow regulator or limiter. By limiting the flow to all areas, a total air flow volume could be chosen to assure that all areas have the same air flow and pressure.

In one aspect, this invention features a fluidized bed for supporting a patient and having a fluid-impervious peripheral wall, a fluid-porous membrane top covering and a fluid-porous floor defining a unit volume in which a quantity of glass bead support media is confined. The media is fluidized by several diffusers which supply air through the floor to fluidize the support media and support a patient on the bed top covering. Each diffuser is a laminate having a porous membrane top and a porous membrane bottom spaced by a fluid-impervious boundary wall and a plurality of fluid-impervious interior walls that create discrete cells. Each cell contains a quantity of glass bead cell media. A pair of blowers supplies pressure air through one-way valves to the cells in the diffusers and through the cells up into the unit interior volume to fluidize the support media. Unequal distribution of support media causes a localized drop in air flow beneath an area of low media density and a consequent air pressure increase in the cells below an area of high media density, to increase air pressure in the support media above, which causes the support media to self-level to equalize pressure throughout the unit volume.

In another aspect, this invention features a bed that is composed of several diffusers beneath the support media, each of which may have varying quantities, depths or sizes of cell media to tailor the air flow from one bed section to another.

In a further aspect, this invention features a method of supporting a body on a fluidized bed which has a fluid-impervious peripheral wall, a fluid-porous membrane top covering, and a fluid-porous floor defining a support volume which confines a quantity of support media, comprising the steps of supplying fluid through said floor to the diffuser support volume through a plurality of valves located beneath the bottom to fluidize the support media, and varying the supply of fluid flowing through each valve as a function of the density of media directly above said valve, thereby creating a pressure differential throughout the support media to cause the support media to self-level through pressure fluid equalization.

These and other objects and features of this invention will become more readily apparent upon reference to the following detailed description of a preferred embodiment, as illustrated in the accompanying drawings, in which:

DETAILED DESCRIPTION OF THE INVENTION

Figure 1:
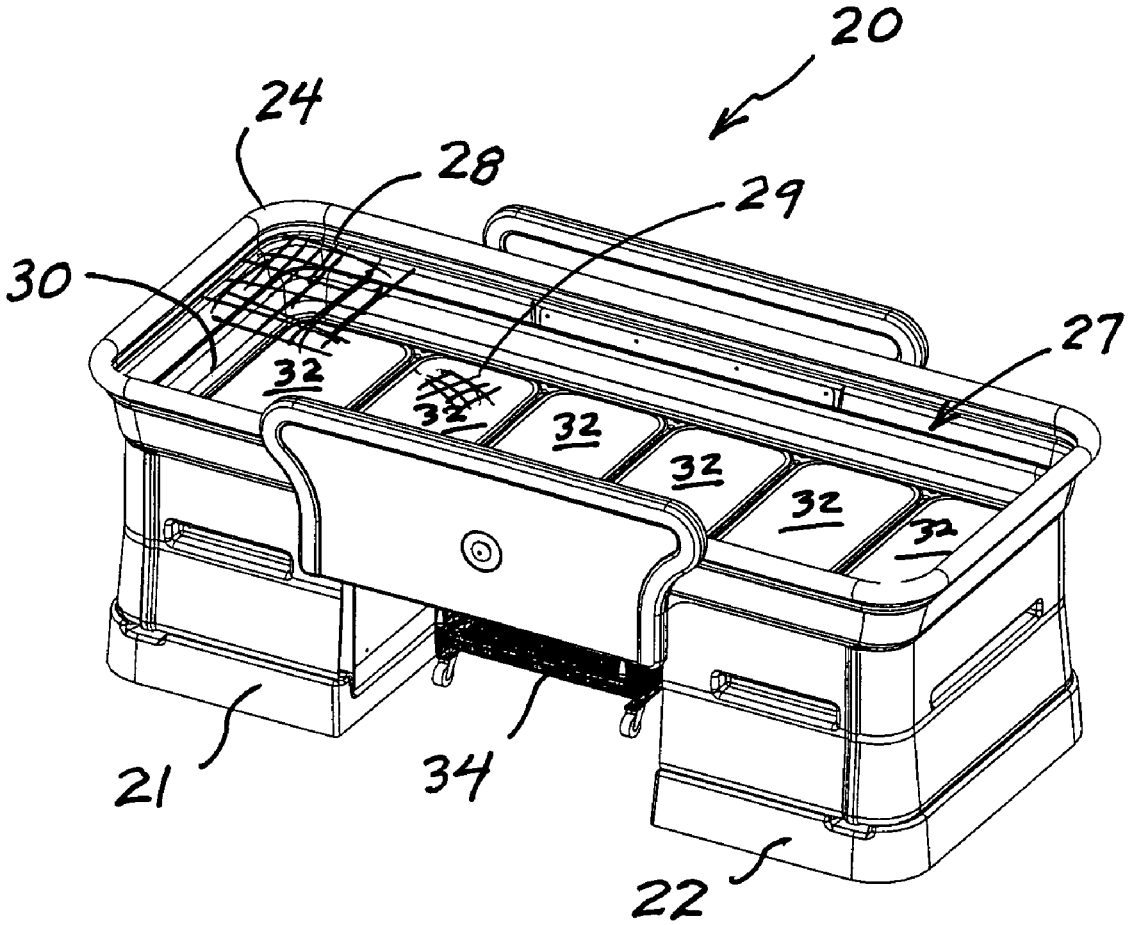
FIG. 1 is a perspective view of a fluidized hospital bed, according to this invention.
Figure 2:
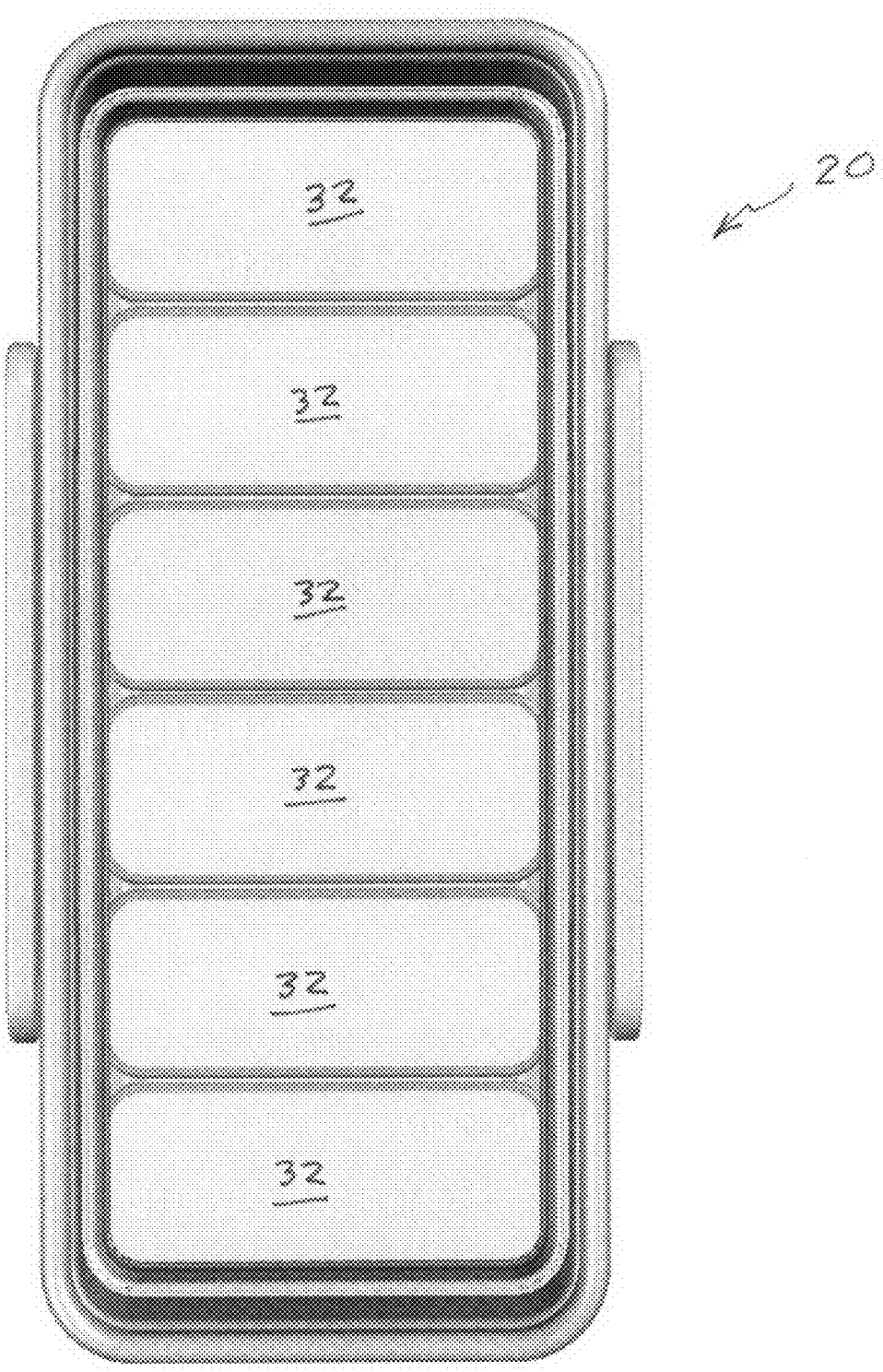
FIG. 2 is a top view of the fluidized hospital bed of FIG. 1.
Figure 3:
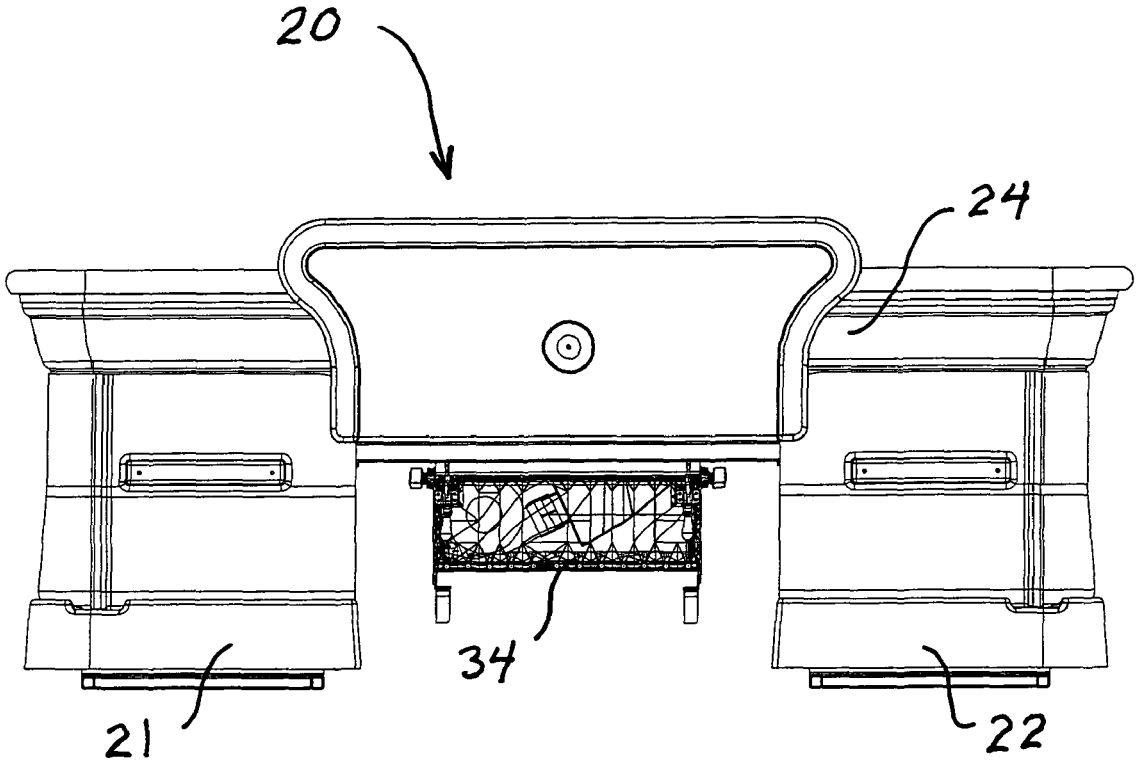
FIG. 3 is a side view of the fluidized hospital bed of FIG. 1.
Figure 4:
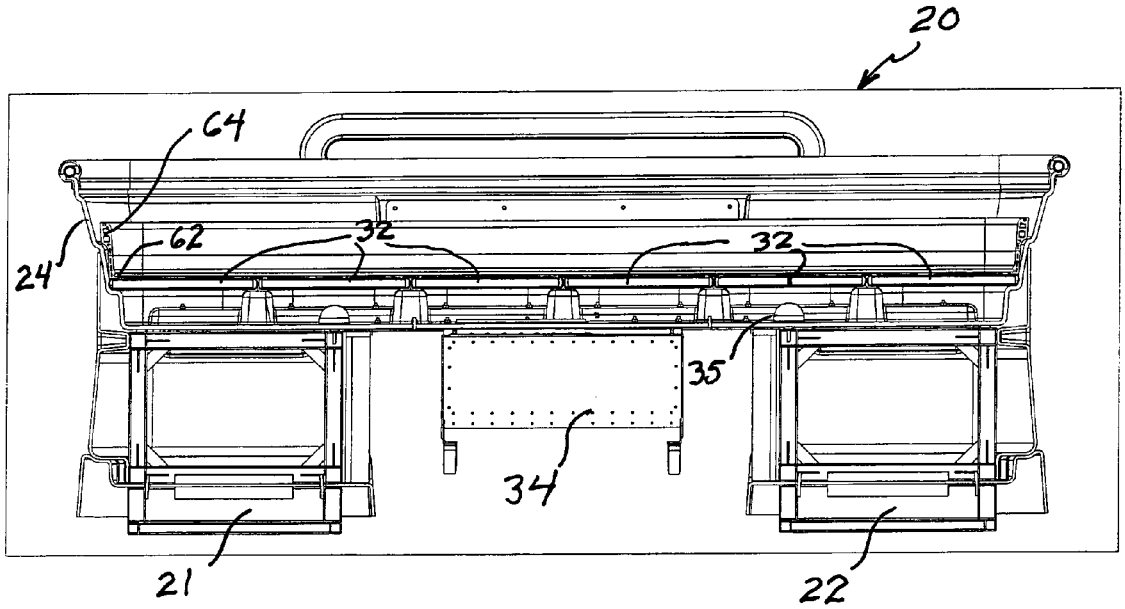
FIG. 4 is a longitudinal sectional view of the fluidized hospital bed of FIG. 1.
Figure 5:
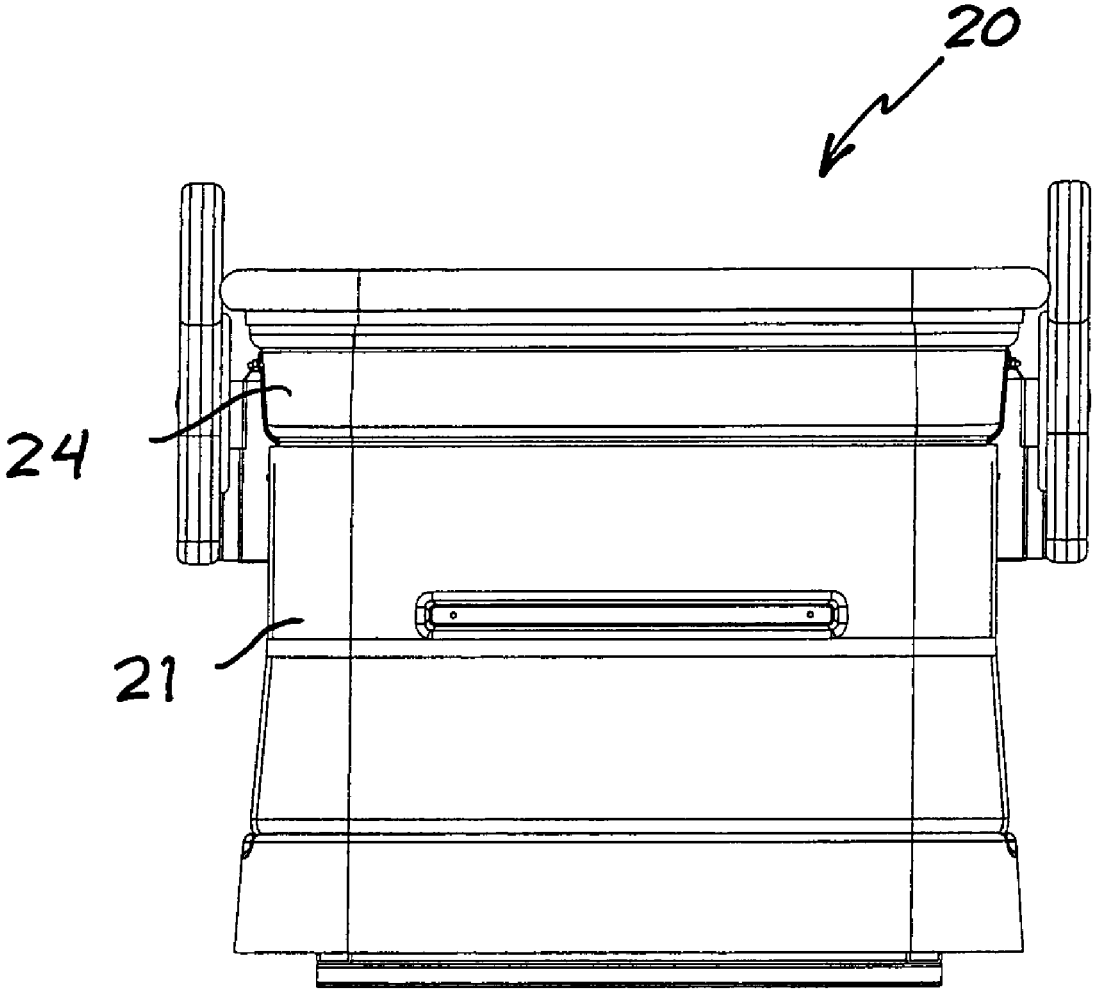
FIG. 5 is an end view of the fluidized hospital bed of FIG. 1.
Figure 6:
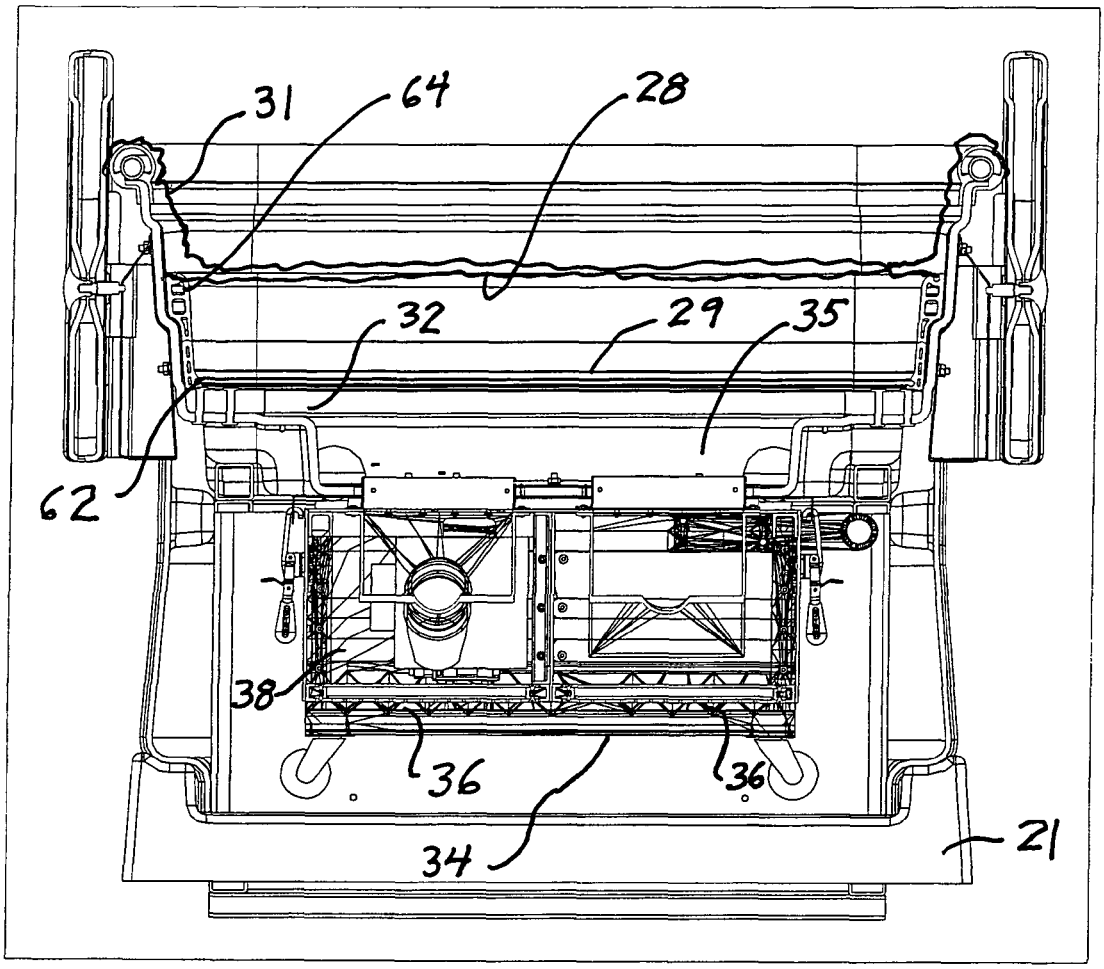
FIG. 6 is a transverse sectional view of the fluidized hospital bed of FIG. 1
Figure 7:
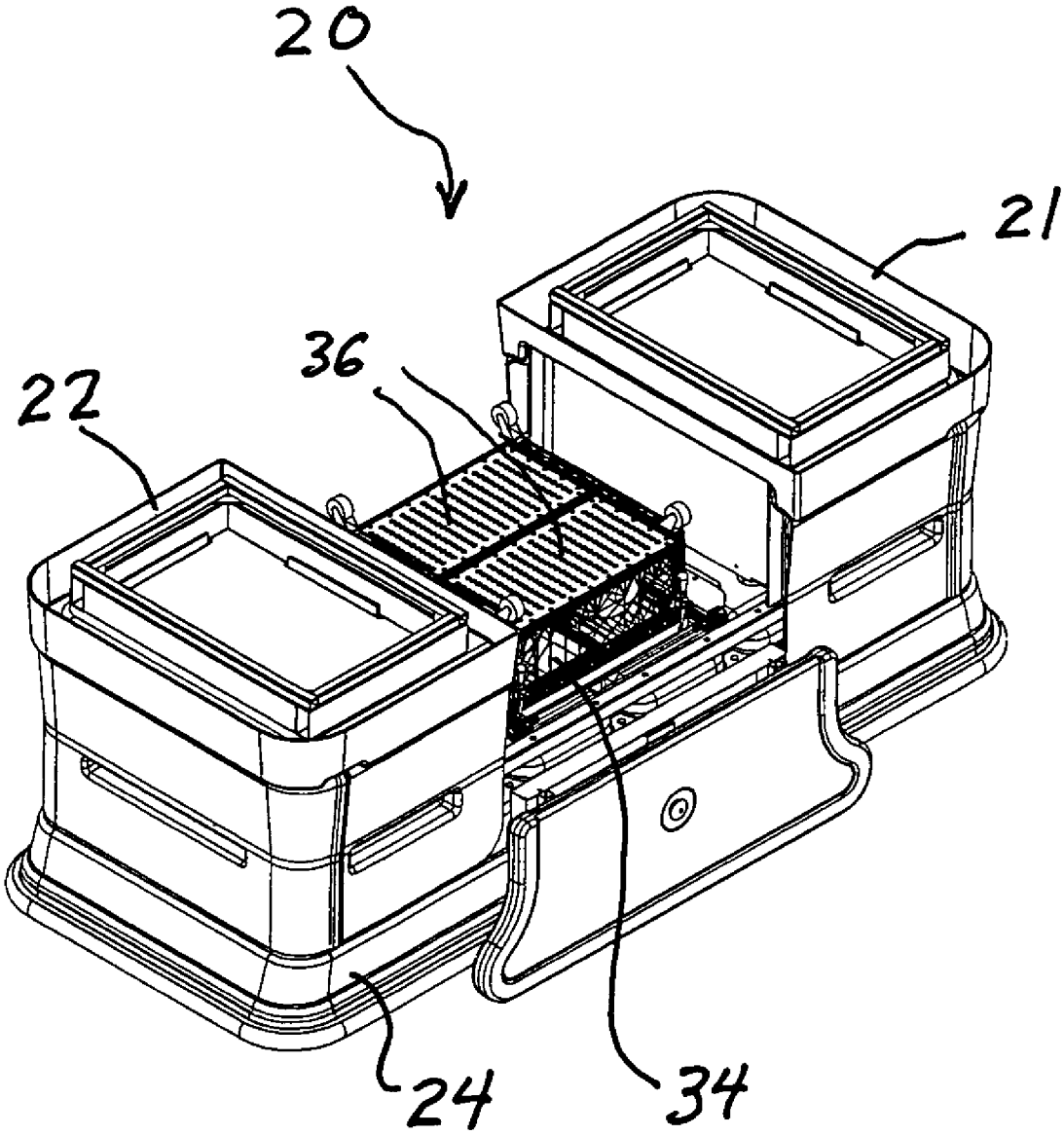
FIG. 7 is a bottom perspective view of the fluidized hospital bed of FIG. 1.
Figure 8:
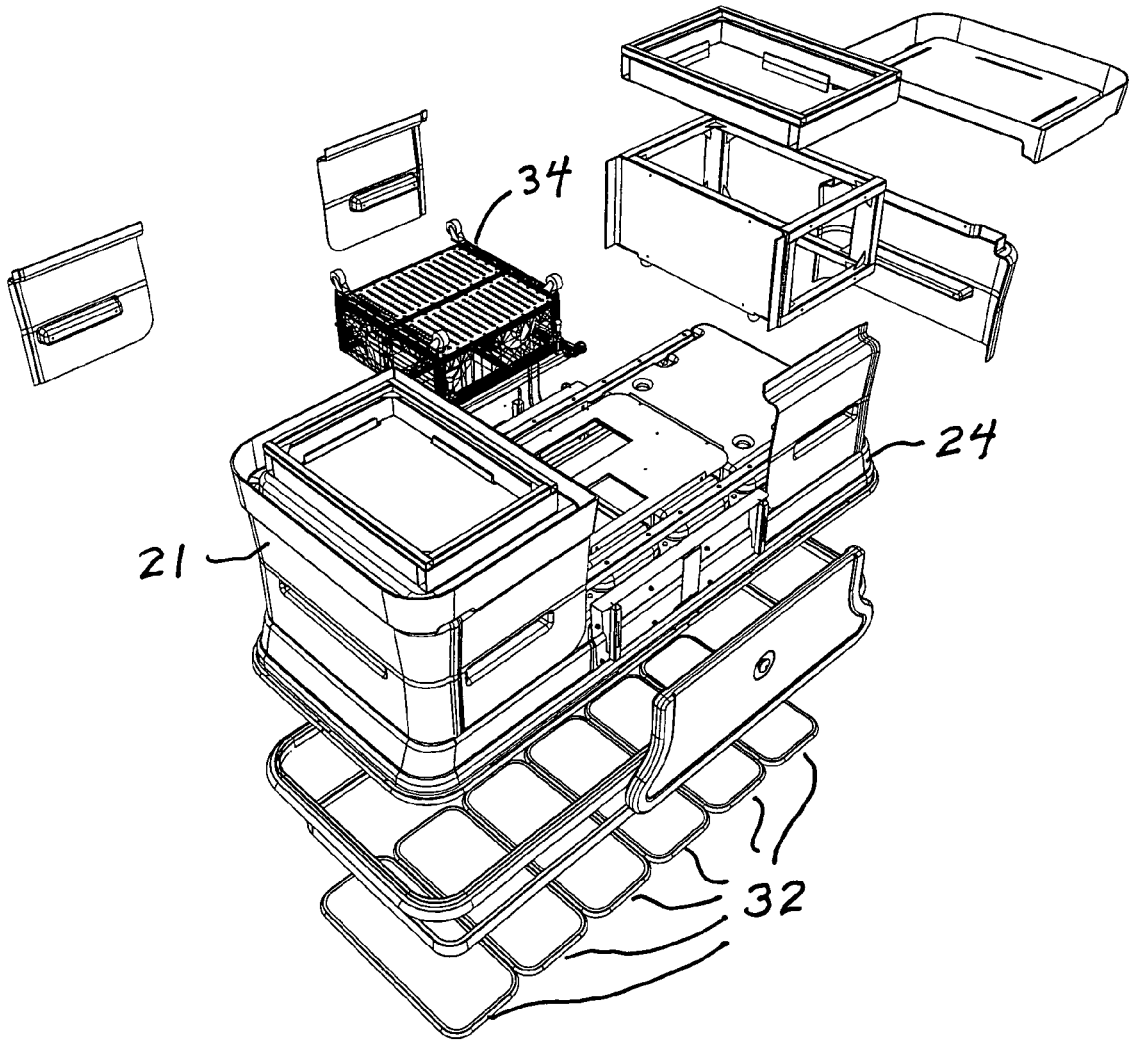
FIG. 8 an exploded perspective view of the fluidized hospital bed of FIG. 1.

Referring now to FIGS. 1-8, a fluid bed 20, according to this invention, comprises a pair of spaced pedestals 21, 22, which support a formed, lightweight plastic tub 24 which defines a flotation unit, or mattress 27, comprising an upper sheet 28 and a lower sheet 29 and the sides 30 of tub 24. Sheets 28, 29 are made of 40μ micro-porous material that is fluid-permeable, but impervious to the passage of the support media. Mattress 27 contains large quantity pellet media, which is fluidizable to support a patient or other body B lying on a cover sheet 31 that lies atop top sheet 28, as will later be described in relation to FIGS. 18, 19. Six discrete air diffusers 32 line the bottom of tub 24 and supply air to the interior of flotation unit 27 through lower sheet 29. A blower assembly 34 supplies air to diffusers 32 through an air plenum 35.

Referring additionally to FIGS. 14-17, blower assembly 34 draws ambient air through a pair of check valves 36 by a pair of blowers 38 (only one shown), located in isolated chambers 39 that house heaters 41. Heated air exits through upper outlets bounded by heat shields 42 into air plenum 35, which distributes air to the six air diffusers 32.

Figure 16:
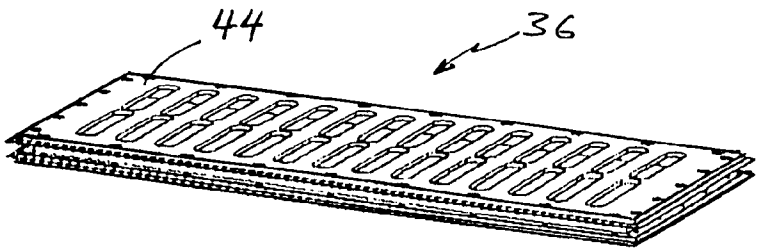
FIG. 16 is a perspective view of one of the blower assembly bottom check valve assemblies.
Figure 17:
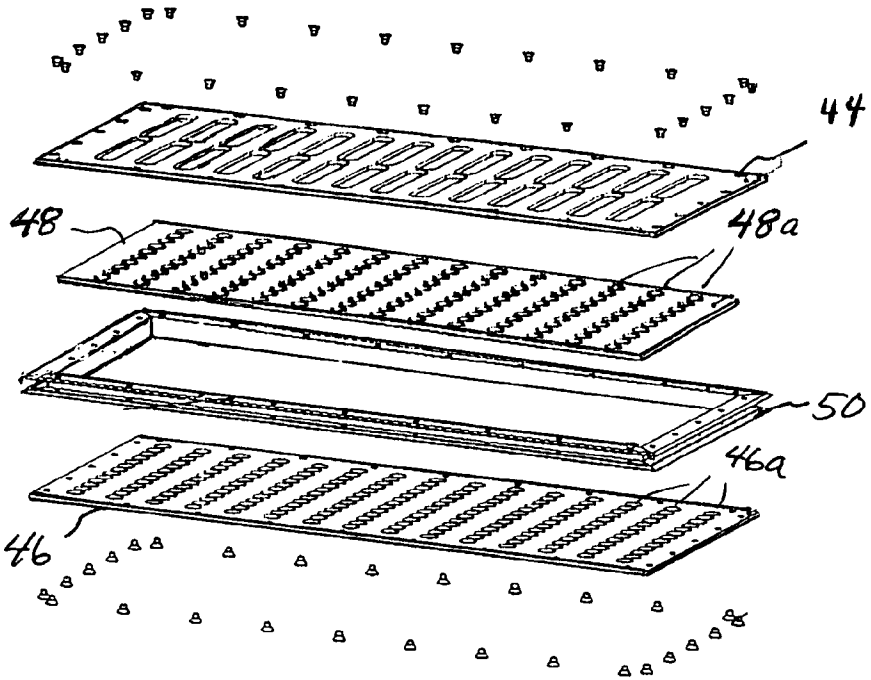
FIG. 17 is a is an exploded perspective view of the check valve assembly of FIG. 16.

As shown in FIGS. 16, 17, each check valve 36 has a cap plate 44 and a bottom plate 46 that confine a check valve gasket 48 for movement within a peripheral frame 50. The circular apertures 48*a* in gasket 48 register with the elongated apertures 44*a* in cap plate 44, but do not register with the circular apertures 40*a* in bottom plate 46. Air entering through bottom plate 46 will force gasket 48 up against cap plate 44 and exit to plenum 35 through the elongated apertures 44*a*. However any air that is forced downwardly through apertures 44*a* will force check valve gasket 48 down against bottom plate 46. Since apertures 44*a* do not register with apertures 48*a*, the air will be trapped within peripheral frame 50 and backflow through bottom plate 46 is prevented.

Figure 9:
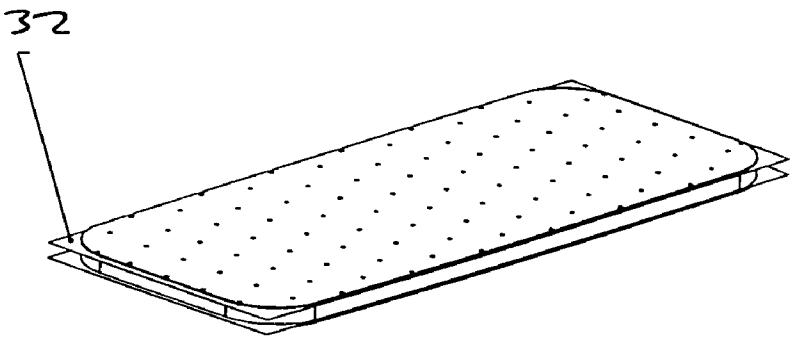
FIG. 9 is a perspective view of a diffuser used in the fluidized hospital bed of FIG. 1.
Figure 10:
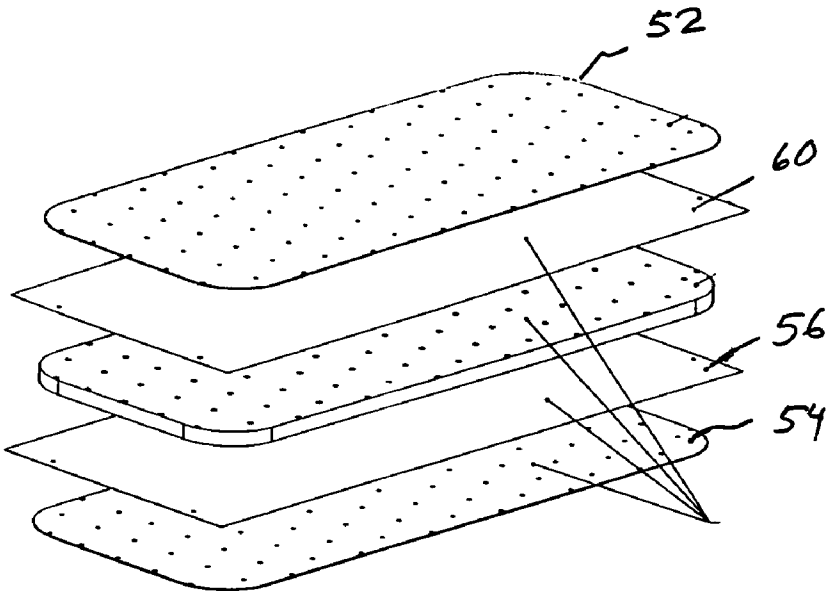
FIG. 10 is an exploded view of the diffuser of FIG. 9.
Figure 11:
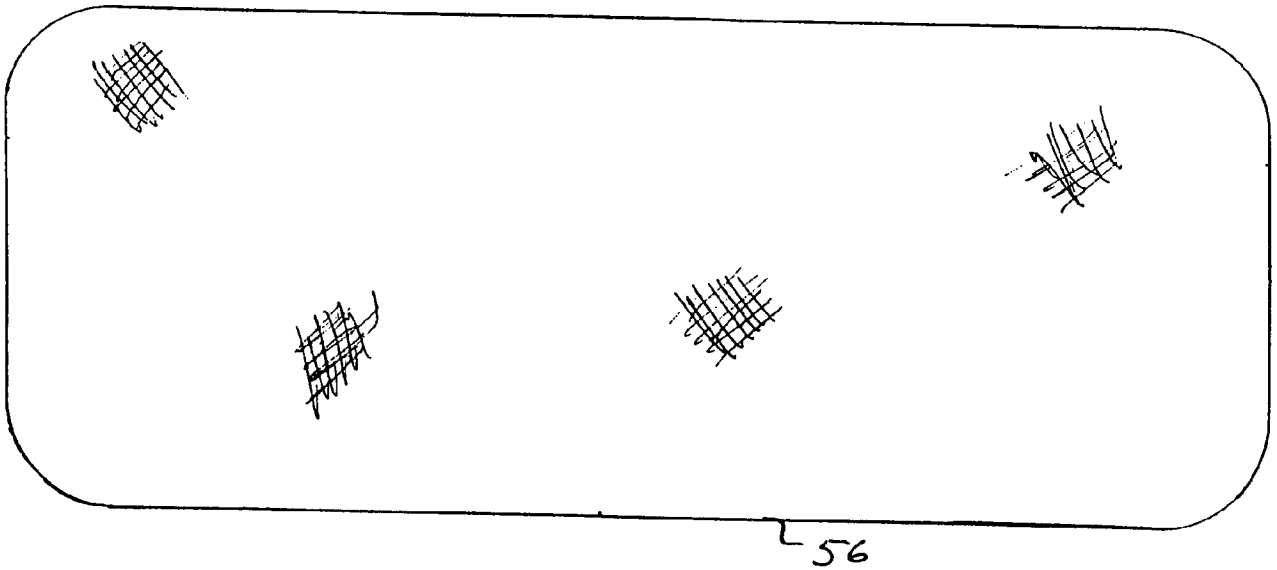
FIG. 11 is a top view of the honeycomb intermediate layer of the diffuser of FIG. 9.
Figure 12:
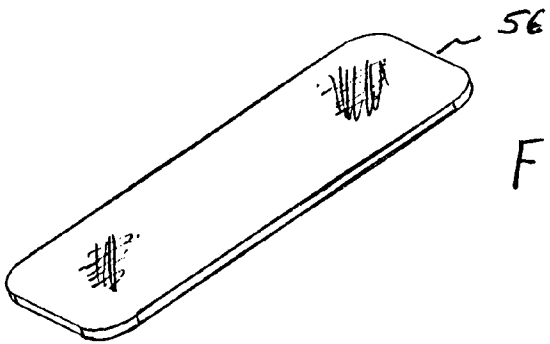
FIG. 12 is a perspective view of the honeycomb intermediate layer of the diffuser of FIG. 9.
Figure 13:
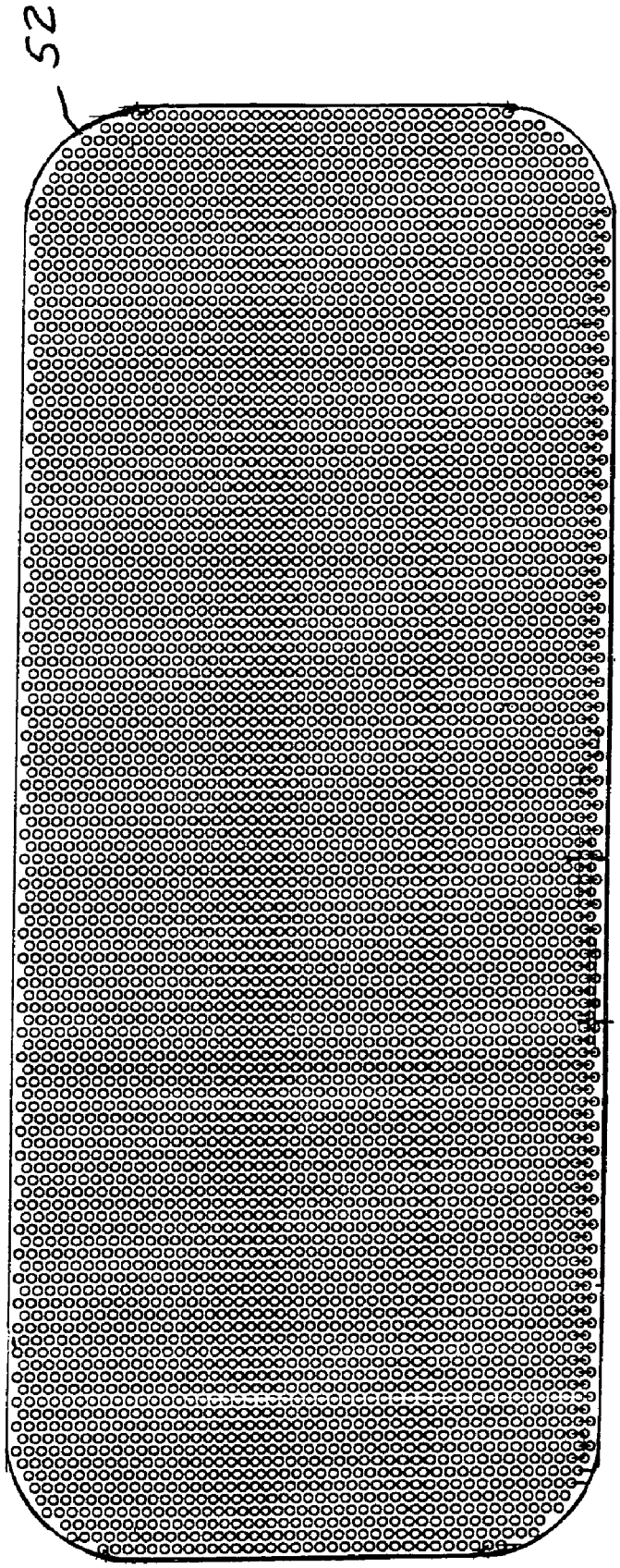
FIG. 13 is a top view of the cover layers of the diffuser of FIG. 9.
Figure 14:
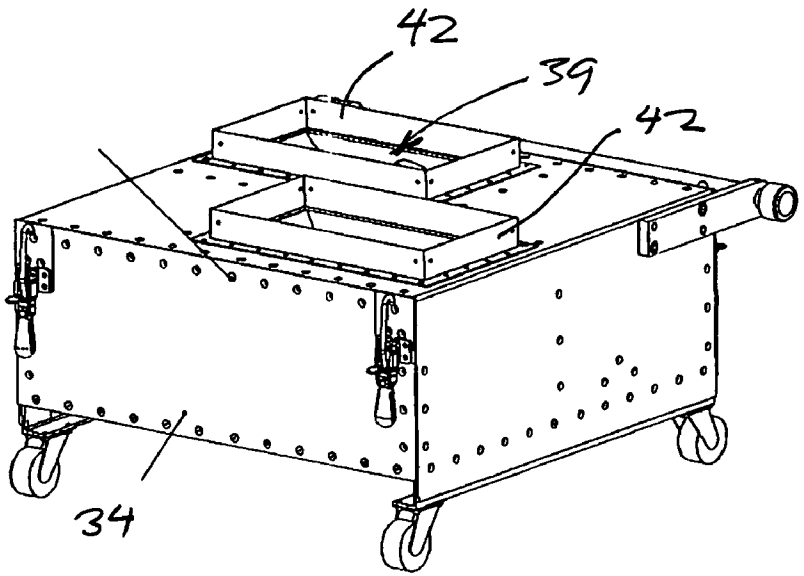
FIG. 14 is a bottom perspective view of the blower assembly of the fluidized hospital bed of FIG. 1.
Figure 15:
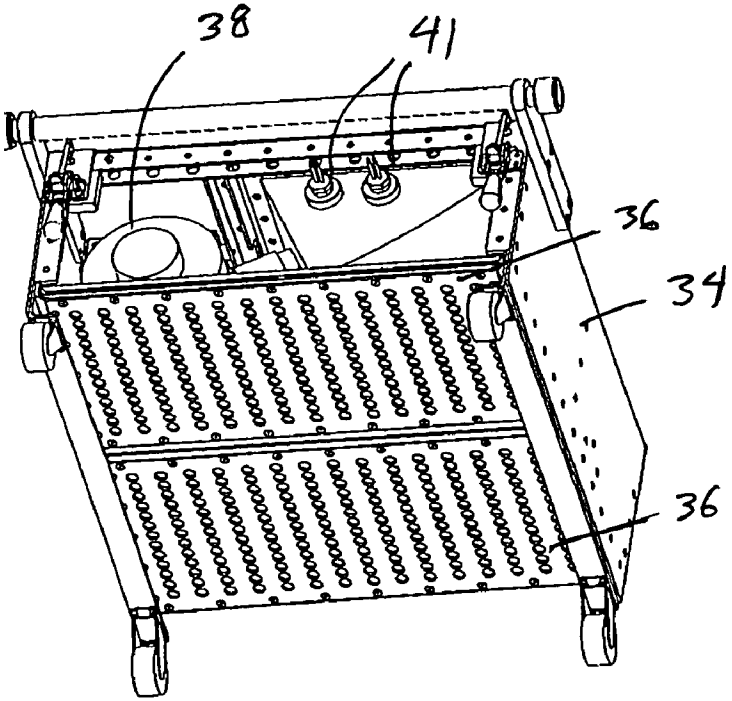
FIG. 15 is a top perspective view of the blower assembly of the fluidized hospital bed of FIG. 1.

As shown in FIGS. 9-12, each of the six diffusers 32 is a laminate that comprises upper and lower diffuser plates 52, 54, and an intermediate layer 56 that is a ⅝" thick aluminum foil honeycomb, manufactured by Alcore. Honeycomb 56 is covered on both sides by micro porous fabric 58, 60. The cells in the honeycomb are quite small, not more then ¼". This structure provides hundreds or thousands of tiny self-valving cells, depending on the size of the bed. The laminate is bonded together to form each diffuser 32, as shown in FIG. 9. Before bonding, the honeycomb cells in intermediate layer 56 are partially filled with a media comprising beads or pellets (preferably spherical silica hospital bed beads available from Potter Industries) that are 63μ-120μ in size. Thus, the micro pores in cloth layers 58, 60 40μ than 60μ to allow air to pass through freely, but confine the beads within the cells.

After diffusers 32 are placed in tub 24, lower sheet 29 is peripherally attached at the bottom of tub 24 and sealed about the periphery by a seal 62. Tub 24 is then filled with media (e.g. 500#) composed of similar size beads (e.g. 40μ) to fill the tub to a predetermined level. Then upper sheet 28 is fitted onto a lower peripheral seal 64. A readily removable cover sheet 66 is fitted about the top periphery of tub 24 to support a body on the bed.

Figure 18:
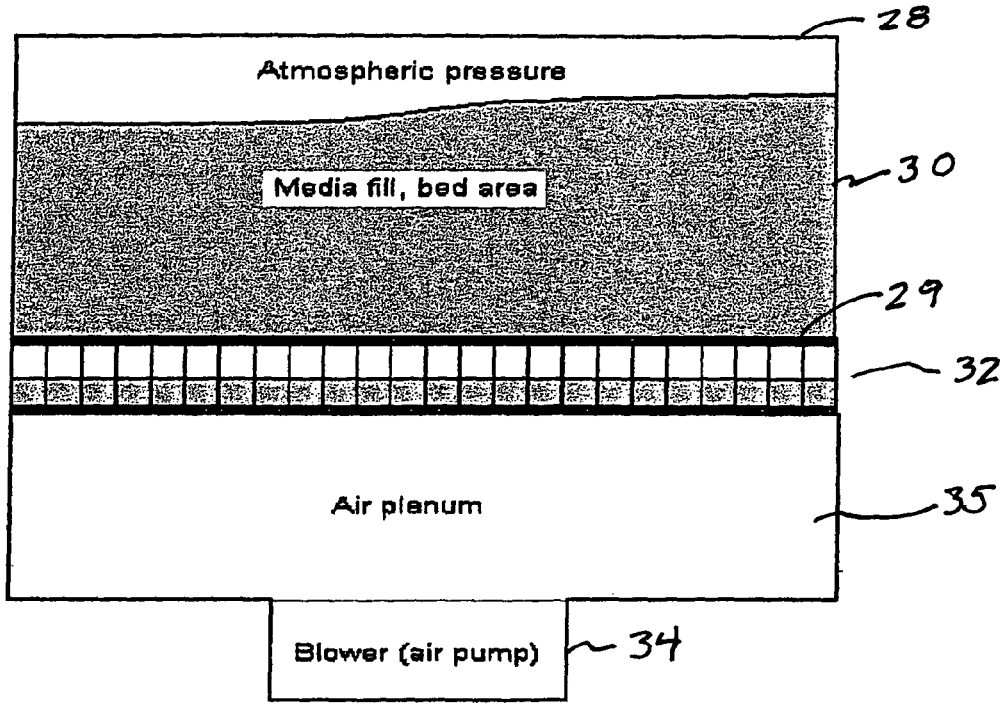
FIGS. 18 and 19 are schematic views of one of the diffusers illustrating the principles of operation.
Figure 19:
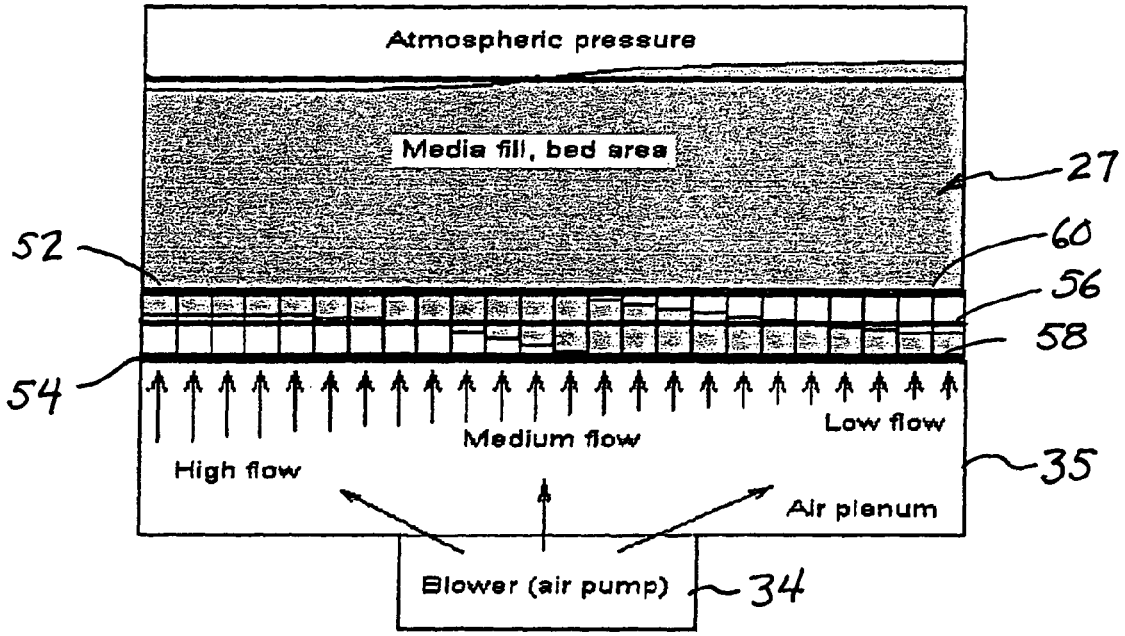

FIGS. 18, 19 schematically illustrate the function of this invention. Each of the media-filled cells in diffusers 32 acts as a self-regulating valve mechanism to even out the air pressure and flow throughout the entire mattress 27. In FIG. 18, the media in mattress 27 is unevenly distributed prior to air flow.

When blowers 38 are activated, heated air will fluidize the media in all cells of diffusers 32 and flow through these cells and out through upper diffuser plates 52 to fluidize the mattress media beads, as depicted in FIG. 19. Initial flow will be greatest at the left end of mattress 27, where the level of media is lower, and air flow will be least at the right end. This disparity of flow will cause the diffuser media at the left end to be forced against the upper cloth layer 60, reducing the air flow. This increases air pressure throughout the diffuser, thus increasing air flow through the right side cells. This causes the mattress media to redistribute to the horizontal black line level (even distribution) as indicated. Thus, when a patient is placed on the mattress, the unequal weight distribution, which causes uneven media distribution in prior art beds, is self-leveling in the bed according to this invention.

It will be noted that two blowers 38 are utilized, both for economy and redundancy. Should one blower 38 fail, the check valve 36 will prevent backflow from the operating blower to the atmosphere and its output will be provided through the common plenum 35 to the entire bed.

Some of the advantages of the fluidized bed set forth above are:

Self-regulating media distribution throughout the bed via equalization of the air flow and air pressure.

Achieving equal air flow via use of media in discrete multiple small closed cells, which act as regulating valves and which are segregated from the support media.

Useful for hospital beds and many other applications where equal support is required for objects other than humans.

Varying media quantity/depth in cells to regulate the point of flow-limiting action.

Use of multiple diffusers, which enables tailoring of air flow from one bed section to another, by varying the quantity of cell media.

Variance of air flow through the cells via the use of different size or shape of media pellets.

The laminated structure of the diffusers which provide compact size, light weight and strong diffusers.

Formed plastic tub to reduce complexity and weight.

Flat check valves for the blowers, which prevent backflow in the event of blower failure, yet enable one blower to supply all diffusers.

Diffuser materials and cell shape can vary as to application and fluid used—air, other gas, liquid.

The unique, self-valving air diffuser could be used in situations where other-than-human bodies must be supported.

This invention provides a unique fluidized bed, especially for bed-ridden patients, that provides constant body support throughout the bed, despite the differing loads paced on various parts of the bed. This is made possible by use of air diffusers, each containing thousands of tiny self-valving cells.

While only a preferred embodiment has been described and shown, obvious modifications are contemplated within the scope of this invention, which is defined by the appended claims.

I claim:

1. A fluidized bed for supporting a body, comprising a fluid-impervious peripheral wall, a fluid-porous membrane top covering, a fluid-porous floor defining a unit volume, a quantity of glass bead support media confined within the unit volume, a diffuser, located beneath the floor for supplying air through the floor to fluidize the support media, comprising a laminate having a porous membrane top and a porous membrane bottom spaced by a fluid-impervious boundary wall and a plurality of interior walls extending from the top to the bottom to create discrete cells, each cell having a quantity of cell media confined within it; and an air supply for supplying pressure air into all cells of the diffuser and through the porous membrane top into the unit interior volume to fluidize the support media, whereby the amount of fluid flow through any specific cell will be affected by the depth of support media above that cell relative to the depth of support media above other cells, such that, in a first area where support media level is low relative to other areas, fluid flow through the first area cells below will increase and cause cell media therein to coalesce at the membrane top to function as a valve and restrict air flow through the top into the support media above, which will decrease fluidization of support media in the first area, and raise fluid pressure in the diffuser, while in a second area where support media level is higher relative to the first area, increased fluid flow through the second area cells below caused by the pressure increase will increase fluid flow through the cells into the support media above to increase fluidization of the media in the second area, and the resultant pressure differential throughout the support media will cause the support media to self-level to equalize fluid pressure throughout the support media.

2. The fluidized bed of claim 1, wherein the quantity of cell media is varied from cell to cell to vary the flow characteristics of fluid through each cell to vary the valving action of the cells relative to each other.

3. The fluidized bed of claim 1, wherein the size of the cell media is varied from cell to cell to vary the flow characteristics of fluid through each cell to vary the valving action of the cells relative to each other.

4. The fluidized bed of claim 1, wherein the fluid is air.

5. The fluidized bed of claim 1, comprising a plurality of said diffusers, each located under a portion of the fluid-porous floor and supplied by the same air supply.

6. The fluidized bed of claim 5, wherein the air supply comprises a pair of fluid supply devices, each supplying different diffusers through one-way valves to prevent backflow from a diffuser.

7. The fluidized bed of claim 6, further including valving means which enable one fluid supply device to supply all diffusers in the event of failure of the other fluid supply device.

8. A method of supporting a body on a fluidized bed which has a fluid-impervious peripheral wall, a fluid-porous membrane top covering, and a fluid-porous floor defining a support volume which confines a quantity of support media, comprising the steps of supplying fluid through said floor to the support volume through a plurality of valves located beneath the floor to fluidize the support media, and varying the supply of fluid flowing through each valve as a function of the density of media directly above said valve, thereby creating a pressure differential throughout the support media to cause the support media to self-level through pressure equalization.

9. In a fluidized bed which includes a quantity of fluidized support media confined within a container that has a fluid-porous floor and an air supply to the floor, the improvement comprising an air diffuser having a plurality of small air valves for regulating the flow of air from the air supply to all areas of the floor, each of said valves being operable to increasingly automatically restrict air flow through the valve in response to increasing air flow through the valve to thereby reduce fluidization of the support media above said valve.

10. A method of supporting a body on a fluidized bed which has a fluid-impervious peripheral wall, a fluid-porous membrane top covering, and a fluid-porous floor defining a support volume which confines a quantity of support media, comprising the steps of:

supplying fluid through said floor to the support volume through a plurality of valves located beneath the floor to fluidize the support media, varying the supply of fluid flowing through each valve as a function of the density of media above said valve, and restricting fluid flow through any valve beneath an area of relatively low support media density to increase fluid pressure and increase fluid flow through any valve beneath an area of relatively high media density to create a pressure differential throughout the support media to cause the support media to self-level through pressure fluid equalization.

11. A method of supporting a body in a fluidized bed which has a fluid-impervious peripheral wall, a fluid-porous membrane top covering, and a fluid-porous floor defining a support volume which confines a quantity of support media, comprising the steps of:

providing a plurality of valves in the form of a plurality of cells, each having a fluid-porous top and bottom bounded by fluid-impervious walls to contain a fluidizable media, the quantity of said media causing the media to coalesce at the top and restrict air flow through the cell as a function of the quantity of fluid flow through the cell, supplying fluid through said floor to the support volume through said plurality of valves located beneath the floor to fluidize the support volume, varying the supply of fluid flowing through each valve as a function of the density of media above said valve, and restricting fluid flow through any valve beneath an area of relatively low support media density to increase fluid pressure and increase fluid flow through any valve beneath an area of relatively high media density to create a pressure differential throughout the support media to cause the support media to self-level through pressure fluid equalization.

12. In a fluidized bed which includes a quantity of fluidized support media confined within a container that has a fluid-porous floor and an air supply to the floor, the improvement comprising an air diffuser having a plurality of small air valves for regulating the flow of air from the air supply to all areas of the floor, each of said valves being operable to increasingly automatically restrict air flow through the valve in response to increasing air flow through the valve to thereby reduce fluidization of the support media above said valve, wherein the plurality of valves comprises a diffuser having a fluid-porous top and bottom which bound a honeycomb body of fluid-impervious walls defining cells, each of which confines a predetermined quantity of cell media, such that air flow through each cell is regulated by fluidization of the cell media, whereby high air flow through a cell causes the cell media to coalesce and restrict air flow.

* * * * *